US010373451B2

(12) United States Patent
Fayfield

(10) Patent No.: US 10,373,451 B2
(45) Date of Patent: Aug. 6, 2019

(54) AUGMENTED SENSING TOWER LIGHT ASSEMBLY

(71) Applicant: Banner Engineering Corp., Plymouth, MN (US)

(72) Inventor: Robert T. Fayfield, Orono, MN (US)

(73) Assignee: Banner Engineering Corp., Plymouth, MN (US)

( * ) Notice: Subject to any disclaimer, the term of this patent is extended or adjusted under 35 U.S.C. 154(b) by 0 days.

(21) Appl. No.: 15/808,531

(22) Filed: Nov. 9, 2017

(65) Prior Publication Data

US 2019/0139377 A1 May 9, 2019

(51) Int. Cl.
*B07C 5/12* (2006.01)
*G08B 5/36* (2006.01)

(52) U.S. Cl.
CPC ..... *G08B 5/36* (2013.01)

(58) Field of Classification Search
CPC ..... G08B 5/36; B65B 5/08; B65G 61/00
See application file for complete search history.

(56) References Cited

U.S. PATENT DOCUMENTS

| | | | | |
|---|---|---|---|---|
| 3,856,639 | A | 12/1974 | Rohn et al. | |
| 4,494,656 | A * | 1/1985 | Shay | G01V 8/12 209/524 |
| 5,642,933 | A | 7/1997 | Hitora | |
| 6,626,557 | B1 | 9/2003 | Taylor | |
| 6,879,263 | B2 | 4/2005 | Pederson et al. | |
| 7,390,257 | B2 | 6/2008 | Paulsen et al. | |
| 7,442,125 | B2 | 10/2008 | Paulsen et al. | |
| 8,018,166 | B2 | 9/2011 | Soccoli et al. | |
| 8,755,039 | B2 | 6/2014 | Ramer et al. | |
| 8,970,372 | B2 | 3/2015 | Primous et al. | |
| 9,175,827 | B2 | 11/2015 | Clore | |
| 2004/0053663 | A1 | 3/2004 | Paulsen et al. | |
| 2006/0044814 | A1 | 3/2006 | Ikeda | |
| 2009/0290961 | A1* | 11/2009 | Langston | B65B 5/04 414/222.01 |

(Continued)

FOREIGN PATENT DOCUMENTS

CN 202018689 U 10/2011

OTHER PUBLICATIONS

Banner Engineering Corp., TL 70 Modular Tower Light, Datasheet, Jun. 20, 2016, Banner Engineering Corp., Minneapolis, MN.

(Continued)

*Primary Examiner* — Hongmin Fan
(74) *Attorney, Agent, or Firm* — Craige Thompson; Thompson Patent Law; Vincent Musgrove

(57) ABSTRACT

Apparatus and associated methods relate to a tower light assembly having an output indicator responsive to an onboard sensor in accordance with a predetermined environmental parameter threshold. In an illustrative example, an augmented sensing tower light assembly (ASTLA) may include a light tower assembly having a controller configured to receive status data from monitored equipment. The controller may further receive environmental data from the onboard sensor. In response to the received status data and the received environmental data, the controller may actuate the output indicator in accordance with one or more predetermined criteria. Advantageously, the ASTLA may provide supplemental low-cost sensing capability.

13 Claims, 8 Drawing Sheets

(56) References Cited

U.S. PATENT DOCUMENTS

| | | | | |
|---|---|---|---|---|
| 2011/0058370 | A1 | 3/2011 | Datz et al. | |
| 2013/0257607 | A1* | 10/2013 | Rigby | B60R 16/02 340/435 |
| 2013/0314916 | A1 | 11/2013 | Clore | |
| 2014/0167619 | A1 | 6/2014 | Land et al. | |
| 2014/0192535 | A1 | 7/2014 | Riffel | |

OTHER PUBLICATIONS

Eco Sensors, Ozone Switch Model OS-6, User Manual, Rev. 1.4, 2013, KWJ Engineering, Inc., Newark, CA.
Menics Signal Technology, PTE Series D56mm Modular Style LED Tower Light, Choose Your Light Product Catalog, p. 4, 2013C, Menics Signal Technology, Korea.
Eco Sensors, SAT-1 Signal Alarm Tower, User Manual, Rev. 1.1, 2013, KWJ Engineering, Inc., Newark, CA.
Eco Sensors, SAT-1 Signal Alarm Tower, Technical Specification, Rev. 1.1, 2013, KWJ Engineering Inc., Newark, CA.
Knowles Electronics, SPU0410HR5H-PB, Product Data Sheet, Mar. 27, 2013, Knowles Electronics LLC, Itasca, IL.

* cited by examiner

AUGMENTED SENSING TOWER LIGHT ASSEMBLY

CROSS-REFERENCE TO RELATED APPLICATIONS

This application is a related to and has the same Assignee as U.S. application Ser. No. 14/803,619 titled "Modular Indicator," filed by Charles Dolezalek, et al., on Jul. 20, 2015.

This application incorporates the entire contents of the foregoing application(s) herein by reference.

TECHNICAL FIELD

Various embodiments relate generally to tower light assemblies.

BACKGROUND

A manufacturing process may yield a variety of products. For example, a manufacturing process may produce electronic circuits, such as microprocessors. Electronic products, such as smartphones, may also be produced via manufacturing processes. Manufacturing processes may produce non-electronic items as well. For example, a manufacturing process may produce lumber.

Different products may involve different manufacturing processes. A food packing manufacturing process may use a conveyor system to transfer a product from station to station. While some stations may call for a user to perform a task along the manufacturing process, some stations may include equipment, such as a robotics station, to automate the performance of a task.

Various stations along a manufacturing process may have a stack light to monitor equipment. A robotics station, for example, may have a stack light to monitor the operation status of the robotics station.

SUMMARY

Apparatus and associated methods relate to a tower light assembly having an output indicator responsive to an onboard sensor in accordance with a predetermined environmental parameter threshold. In an illustrative example, an augmented sensing tower light assembly (ASTLA) may include a light tower assembly having a controller configured to receive status data relating to monitored equipment. The controller may further receive environmental data from the onboard sensor. In response to the received status data and the received environmental data, the controller may actuate the output indicator in accordance with one or more predetermined criteria. Advantageously, the ASTLA may provide supplemental low-cost sensing capability.

Various embodiments may achieve one or more advantages. For example, some embodiments may include an onboard programmable controller operably connected to a sensor to provide supplemental monitoring capabilities. A user may program the onboard controller in accordance with a predetermined humidity threshold, for example. In an illustrative example, the onboard controller may be programmed to have a low humidity threshold in a first application. The onboard controller may be programmed to have a high humidity threshold in a second application. In the event that the onboard sensor fails, a user may simply replace the ASTLA.

The ASTLA may provide a monitoring space capability around the monitored equipment. For example, the ASTLA may include a sensor to detect noise around the monitored equipment. Further, the monitoring space may provide an earlier indication of a potentially detrimental environmental parameter. In some embodiments, the monitoring space may be directed away from the monitored equipment to increase the likelihood of early detection of an unfavorable environmental parameter, for example.

The ASTLA may be programmed to alert a user in the event of a detected environmental parameter in addition to a triggering event from the monitored equipment. The ASTLA may illuminate the output indicator (e.g., indicator light) in different patterns based on a triggering event or a detected environmental parameter from the onboard sensor such that a user may quickly identify the source and type of alert.

The ASTLA may be modular to permit various arrangements of the ASTLA. For example, a ASTLA may include one or more sensor modules for a custom application specific ASTLA. The ASTLA may include a modular component to be retrofitted to conventional tower light assemblies. As such, the ASTLA may provide supplemental low-cost sensing capabilities to a preexisting tower light assembly, for example. The ASTLA may include a control unit having networking capabilities to transmit and receive collected sensor information to and from a remote processing station. Advantageously, a less sophisticated controller may be used by the ASTLA. The networking capabilities may increase a user's freedom of movement because the user may receive alerts and information from the ASTLA via a portable electronic device. The user may adjust settings to the ASTLA via the portable electronic device without the necessity of traveling to the ASTLA.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, an exemplary augmented sensing tower light assembly (ASTLA) is briefly introduced with reference to FIG. 1. Second, with reference to FIGS. 2-3, the discussion illustrates a self-contained ASTLA embodiment and a modular ASTLA embodiment. With reference to FIG. 4, the discussion turns to an exemplary ASTLA control unit. Then, with reference to FIG. 5, a monitoring sequence for an exemplary ASTLA is presented. Finally, with reference to FIG. 6, the networking capabilities of multiple ASTLAs are discussed.

Figure 1:
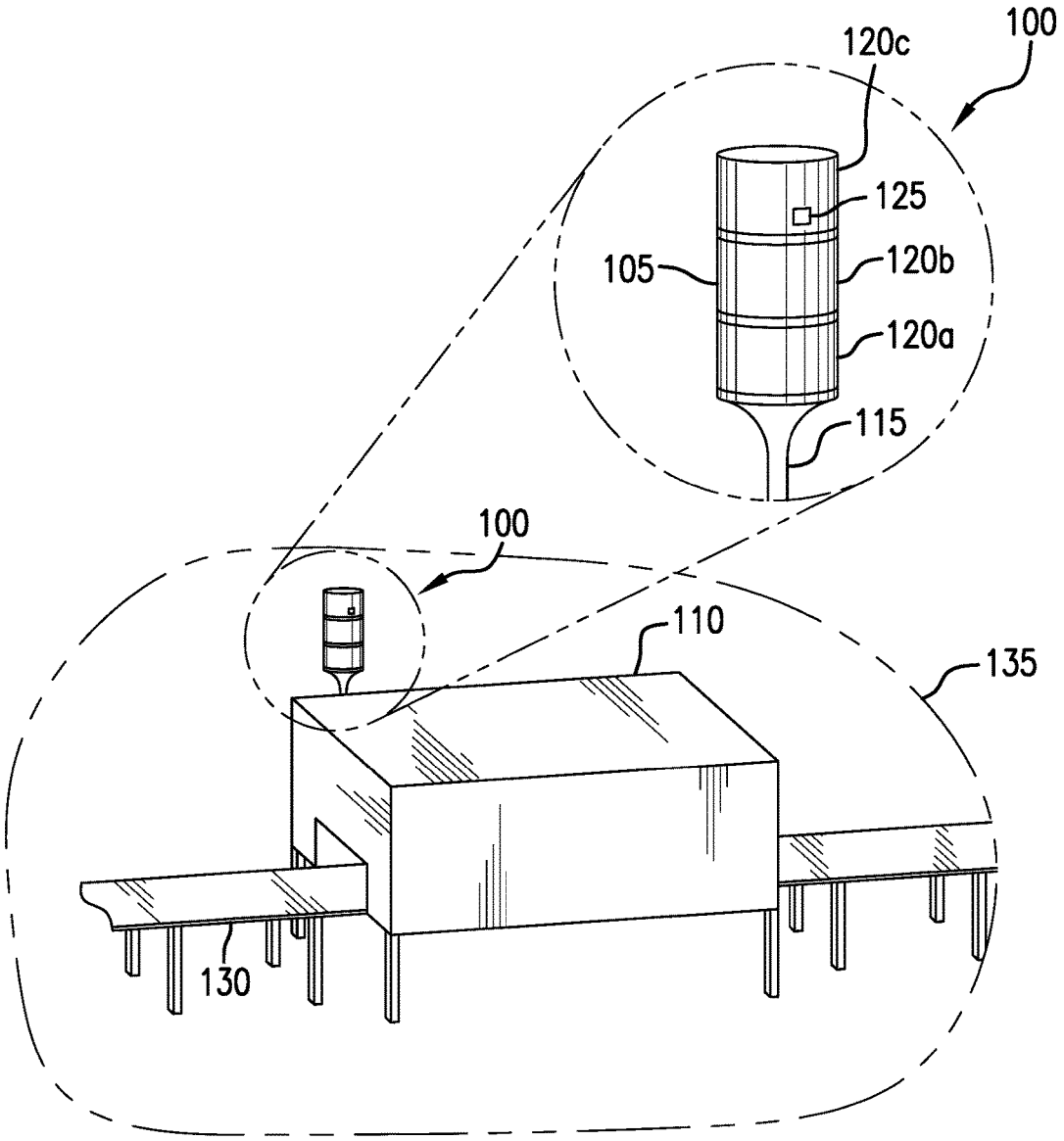
FIG. 1 depicts a perspective view of a manufacturing facility having an exemplary augmented sensing tower light assembly (ASTLA).

FIG. 1 depicts a perspective view of a manufacturing facility having an exemplary augmented sensing tower light assembly (ASTLA). An ASTLA 100 includes a tower light assembly 105. The tower light assembly 105 couples to a unit of monitored equipment 110 via an electrical conduit 115. The tower light assembly 105 includes three indicator lights 120*a*-120*c* and an onboard sensor 125. The ASTLA 100 may illuminate the indicator lights 120*a*-120*c* in response to status data received from the monitored equipment 110 while also simultaneously illuminating the indicator lights 120*a*-120*c* in response to environmental parameter data received from the onboard sensor 125. The onboard sensor 125 may detect environmental parameters external to the monitored equipment. As such, the ASTLA 100 may provide a single, multi-purpose tower light assembly 105 with extended capabilities on existing infrastructure.

A conveyor belt 130 travels along a path through the monitored equipment 110. The onboard sensor 125 monitors a monitoring space 135 to detect an environmental parameter, for example. As depicted, the monitoring space 135 spherically extends beyond the area of the monitored equipment 110. In some embodiments, the monitored equipment 110 may include one or more devices. As such, the ASTLA 100 may monitor an augmented area to more quickly detect potentially detrimental environmental parameters such as humidity, for example. In an illustrative example, in a wave soldering application, the ASTLA 100 may, via the onboard sensor 125, detect a potentially detrimental environmental parameter such as water, for example, from a malfunctioning sprinkler head. The augmented monitoring space 135 may prevent wet circuit boards from being processed into scrap (e.g., waste) by the monitored equipment 110.

Figure 2:
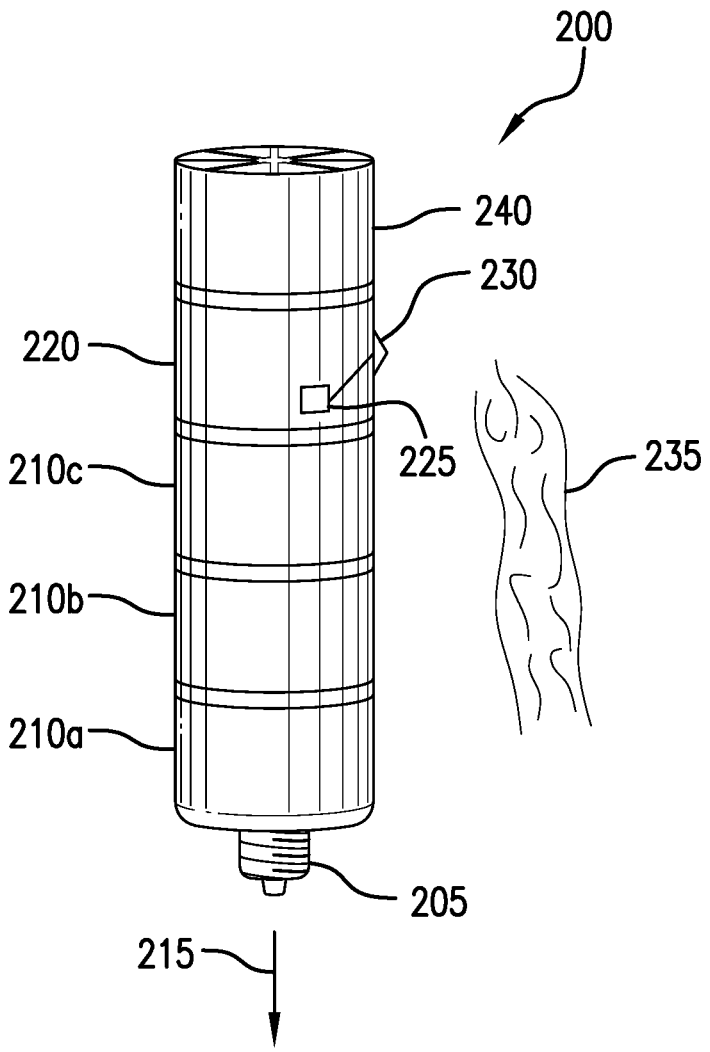
FIG. 2 depicts a perspective side view of an exemplary ASTLA having an audio output indicator and a light output indicator.

FIG. 2 depicts a perspective side view of an exemplary ASTLA having an audio output indicator and a light output indicator. A unitary construction forms the ASTLA 200. The ASTLA 200 includes an interface connector 205. The interface connector 205 may mechanically and electrically connect the ASTLA 200 with the monitored equipment 110, with reference to FIG. 1. An electrical connection (not shown) established between the monitored equipment 110 and the ASTLA 200 may provide data distribution between the monitored equipment 110 and the ASTLA 200. The ASTLA 200 may receive status data from the monitored equipment 110 via the interface connector 205. In some embodiments, the interface connector 205 may provide quick-connect capabilities such as orientation independent connectors, for example. A keyed interface connector 205 may provide a secure method for electrically connecting the ASTLA 200 to the monitored equipment 110.

As depicted, the ASTLA 200 includes a set of three indicator lights 210*a*-210*c* operably mounted on the interface connector 205 along an axis 215. The axis 215 extends through a center of the interface connector 205. The indicator lights 210*a*-210*b* may radially illuminate from the axis 215 when actuated. A sensor module 220 mounts to the indicator light 210*c*. The sensor module 220 includes a controller 225 and an onboard sensor 230. The controller 225 electrically connects to the onboard sensor 230. The onboard sensor 230 may detect an environmental parameter 235 within a monitoring space, for example. A triggering event (e.g., detected parameter exceeds a predetermined threshold) may cause the controller 225 to actuate the indicator lights 210*a*-210*c*. The controller 225 may compare received environmental parameter data to one or more predetermined parameter criteria to determine a triggering event.

The ASTLA 200 includes an audio indicator 240. The audio indicator 240 operably mounts to the sensor module 220. The controller 225 may actuate the audio indicator 240 to produce a sound pattern in accordance with one or more predetermined sound criteria. For example, the controller 225 may receive status data from the monitored equipment 110. In response to the received status data, the controller 225 may actuate the audio indicator 240 in accordance with a first predetermined sound pattern corresponding to the monitored equipment 110. The controller 225 may actuate the audio indicator 240 in response to a second predetermined sound pattern corresponding to the sensor module 220.

In various embodiments, a user may program the controller 225 to actuate the same predetermined sound pattern independent of whether a triggering event was received from the onboard sensor 230 or the monitored equipment 110. The controller 225 may determine a triggering event from status data received from the monitored equipment 110.

A user may program the controller 225 to identify various triggering events. The user may further program the controller 225 to actuate various audio and visual indicators in accordance with the various triggering events. For example, the sensor module 220 may detect an environmental parameter near yet below a predetermined parameter threshold. In such an event, the controller 225 may actuate the light indicator 210*b* to flash yellow, for example, to provide an early indication of a potentially hazardous environmental parameter. In the event the environmental parameter exceeds the predetermined environmental parameter threshold, the controller 225 may actuate the light indicator 210*c* to flash red, for example. The controller 225 may also actuate the audio indicator 240 to sound in accordance with a predetermined audio pattern to alert a user that the environmental parameter exceeds the predetermined environmental parameter threshold.

Figure 3:
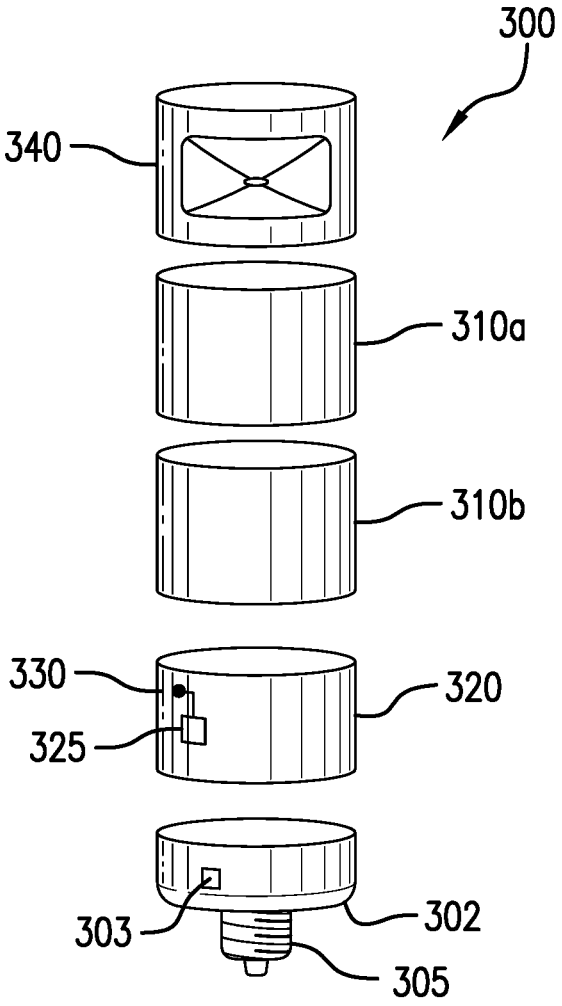
FIG. 3 depicts a perspective side view of an exemplary modular ASTLA having an audio output indicator and a light output indicator.
Figure 4:
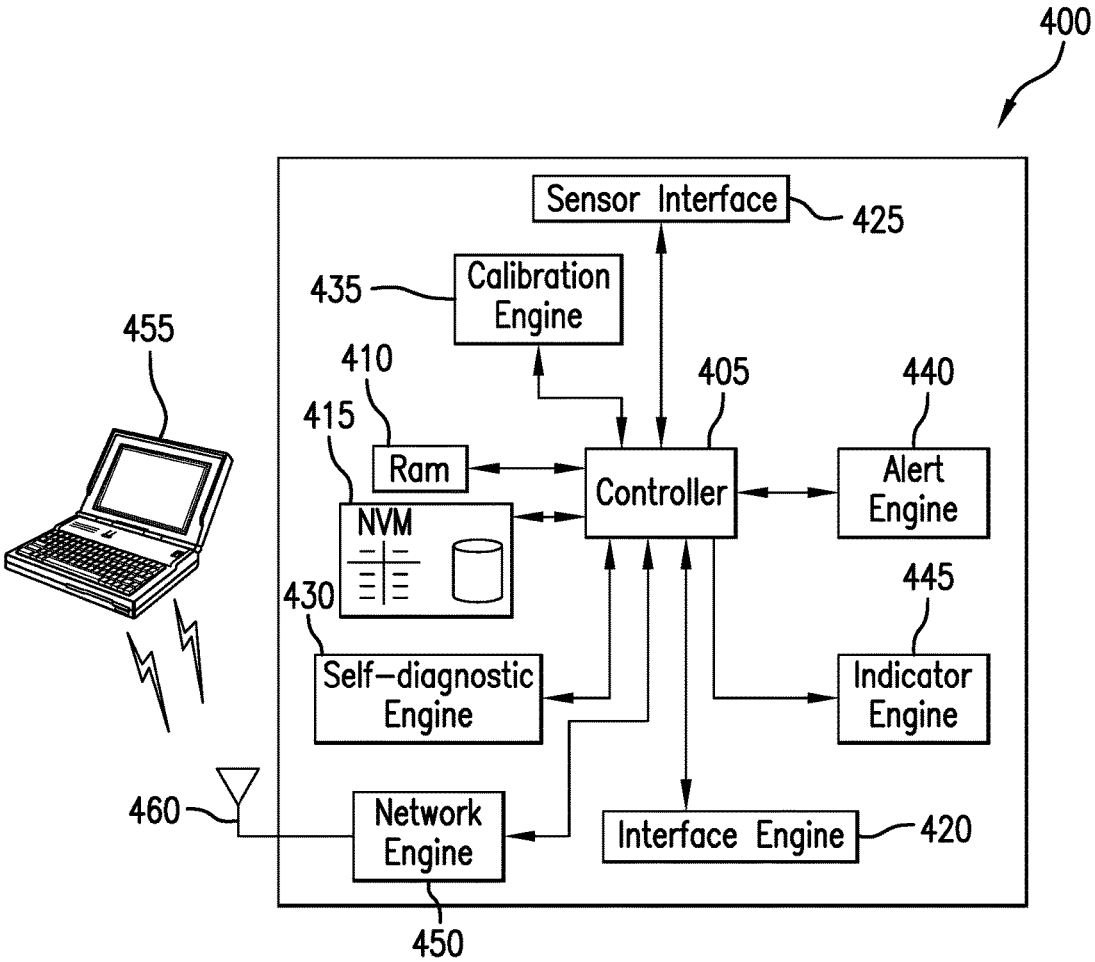
FIG. 4 depicts a block diagram view of an exemplary ASTLA control unit.

FIG. 3 depicts a perspective side view of an exemplary modular ASTLA having an audio output indicator and a light output indicator. A modular ASTLA 300 includes a base module 302. The base module 302 includes a tower light controller 303 and an interface connector 305. With reference to FIG. 1, the tower light controller 303 via the interface connector 305 may operably connect to monitored equipment 110. The ASTLA 300 includes a sensor module 320, a pair of light indicator modules 310*a*, 310*b*, and an audio indicator module 340. In some embodiments, the light indicator modules 310*a*, 310*b* may operably connect to the tower light controller 303. The sensor module 320 includes a sensor controller 325 operably connected to an onboard sensor 330. Each module 310*a*, 310*b*, 320, 340 includes module connectors such that a user may stack the modules 310*a*, 310*b*, 320, 340 in any order. The module connectors may include spring contacts to form an electrical communication path among the modules 310*a*, 310*b*, 320, 340. The electrical communication path may transmit data signals and operating power, for example, among the modules 310*a*, 310*b*, 320, 340. As depicted, the modules 310*a*, 310*b*, 320, 340 include a cylindrical-housing. The module connectors may include a quick disconnect connector, such as a twist-and-turn connector, for example. Such module connectors have been described in U.S. patent application Ser. No. 14/803,619 titled "Modular Indicator" filed by Charles Dolezalek et al., on Jul. 20, 2015, the entire contents of the foregoing application(s) are herein by incorporated by reference.

In some embodiments, the ASTLA 300 may include additional modules. For example, the ASTLA 300 may include an additional onboard sensor to permit the ASTLA 300 to monitor two different environmental parameters, such as, for example, air pressure and proximity. As such, the ASTLA 300 may provide a supplemental low-cost sensing capability. The onboard sensor 330 may include a microphone to detect sounds within a predetermined frequency or within a predetermined frequency profile within a monitoring space, such as the monitoring space 135, for example. The microphone may detect, for example, that a product (e.g., circuit board) has fallen off of the conveyor belt 130 by recognizing the sound produced by the product hitting the floor as being within a predetermined frequency or within a predetermined frequency profile. The onboard sensor 340 may include a vibration detector to detect vibrations of the monitored equipment 110. The onboard sensor 340 may detect vibrations outside of a predetermined vibration profile to indicate a malfunction of the monitored equipment 110. In some examples, an acoustic sensor may be configured to detect acoustic signals that may be indicative of a bearing failure. For example, a rotating machine having a bearing that has failed may give of a 32-36 kHz acoustic signature, which may be picked up by the acoustic sensor and used to alert relevant personnel that a machine failure has occurred.

Each light indicator module 310*a*, 310*b* may include an onboard sensor (e.g., the onboard sensor 340) and a controller (e.g., the sensor controller 325) such that each indicator module 310*a*, 310*b* provides augmented sensing capabilities. In some embodiments, the light indicator module 310*a* may include the sensor controller 325 while the light indicator module 310*b* includes the onboard sensor 340. Additional modules having an onboard sensor may operably connect to the light indicator module 310*a* such that the sensor controller 325 operates any onboard sensor operably connected to the light indicator module 310*a*. In some embodiments, the indicator modules 310*a*, 310*b* may operably connect to the tower light controller 303, for example. The tower controller 303 and the sensor controller 325 may operate independently of each other. For example, the tower controller 303 may communicate independently with a first remote station while the sensor controller 325 communicates independently with a second remote station.

FIG. 4 depicts a block diagram view of an exemplary ASTLA control unit. An ASTLA control unit 400 includes a controller 405. The controller 405 operably connects to random-access-memory (RAM) 410 and to non-volatile memory (NVM) 415. The NVM 415 may include look-up tables (LUT) to store one or more parameters associated with one or more predetermined criteria. The predetermined criteria may include criteria corresponding to environmental parameters and monitored equipment status parameters. The NVM 415 may include program instructions to generate actuation commands to output indicators, such as indicator lights and audio indicators, for example.

The controller 405 operably connects to an interface engine 420. With reference to FIG. 1, the controller 405 may receive and transmit data signals to the monitored equipment 110, for example. The controller 405 may receive operating power from the interface engine 420. A sensor interface 425 operably connects to the controller 405. The controller 405 may receive environmental parameter data via the sensor interface 425 from an onboard sensor (e.g., onboard sensor 340). The controller 405 may implement various sample rates when receiving data. For example, the controller 405 may receive status data from the monitored equipment 110 at a first sample rate while receiving environmental parameter data from the onboard sensor at a second sample rate. In various embodiments, the first sample rate and the second sample rate may equal each other.

A self-diagnostic engine 430 operably connects to the controller 405. The self-diagnostic engine 430 may perform diagnostic operations to ensure the sensor interface 425, for example, functions according to one or more predetermined criteria. In the event that the controller 405 detects, via the self-diagnostic engine 430, a malfunction with an onboard sensor, for example, the controller 405 may recalibrate, via a calibration engine 435, the onboard sensor to rectify the malfunction. An alert engine 440 operably connected to the controller 405 may generate an alert message in response to a malfunction, for example.

An indicator engine 445 operably connects to the controller 405. The controller 405 may transmit an actuate command to an output indicator, such as a light indicator, for example, via the indicator engine 445. A network engine 450 operably connects to the controller 405. The controller 405 may transmit, via the network engine 450, a generated alert message, for example, to a remote control station. The remote control station may be a computer, for example. The remote control station may function as a processing station to perform analytics, such as executing an FFT algorithm to analyze harmonic content detected by a vibration sensor, for example. As such, a less sophisticated controller 405 may be used in the ASTLA control unit 400.

The network engine 450 may transmit data to a portable electronic device 455 via a wireless component 460. With reference to FIG. 3, the portable electronic device 455 may permit a user to monitor the ASTLA 300 independent of location. In an illustrative example, the user may adjust one or more predetermined criteria via the portable electronic device 455.

Figure 5:
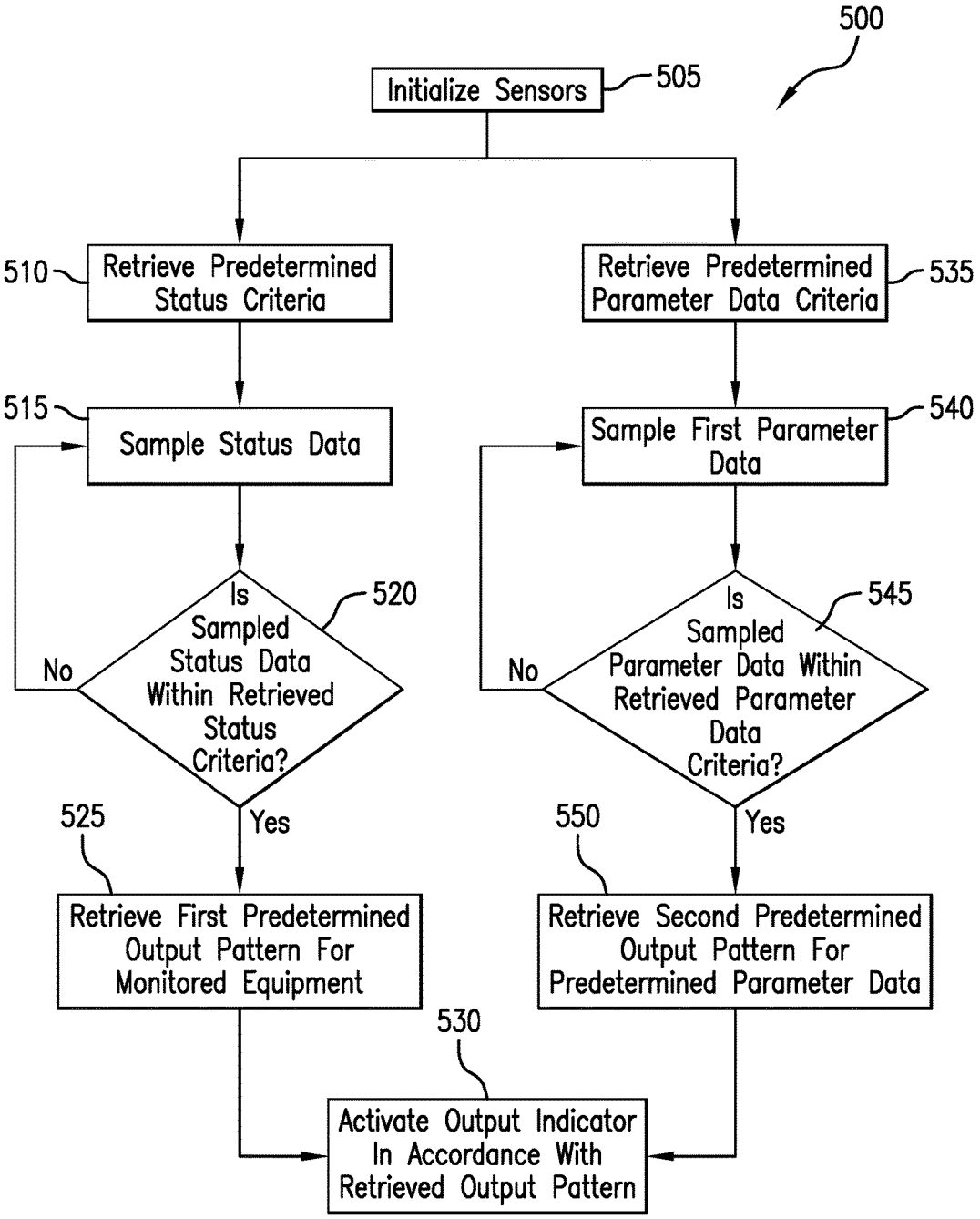
FIG. 5 depicts a flowchart illustrating a monitoring sequence for an exemplary ASTLA.

FIG. 5 depicts a flowchart illustrating a monitoring sequence for an exemplary ASTLA. With reference to FIG. 2, a monitoring sequence 500 commences, at 505, with the initialization of the ASTLA 200. With reference to FIG. 4, the controller 405 retrieves, at 510, a predetermined status data threshold for the monitored equipment 110 from the NVM 415. At 515, the controller 405 samples status data from the monitored equipment 110. The controller 405 may receive status data via the interface connector 305, for example. The controller 405 determines, at 520, whether the received sampled status data, from 515, exceeds the retrieved predetermined status data threshold.

If, at 520, the controller 405 determines the received sampled status data does not exceed the retrieved predetermined status data threshold, the controller 405 continues, at 515, to sample status data from the monitored equipment 110. If, at 520, the controller 405 determines the received sampled status data does exceed the retrieved predetermined status data threshold, the controller 405 retrieves, at 525, a first predetermined output pattern corresponding to the predetermined status data threshold. The controller 405 may retrieve the first predetermined output pattern from the NVM 415. At 530, the controller 405 transmits an actuate command to an output indicator in accordance with the retrieved first predetermined output pattern.

At 535, the controller 405 retrieves a predetermined parameter data threshold. The controller 405 may retrieve the predetermined parameter data threshold from the NVM 415. In some embodiments, the controller 405 may receive the predetermined parameter data threshold from a portable device, such as a smartphone, for example, via the network interface engine 450. At 540, the controller 405 samples parameter data received from the onboard sensor 230, for example. At 545, the controller 405 determines whether the sampled parameter data exceeds the retrieved predetermined parameter data threshold.

If, at 545, the controller 405 determines the sampled parameter data does not exceed the retrieved predetermined parameter data threshold, the controller 405 continues, at 540, to sample parameter data from the onboard sensor 230. If, at 545, the controller 405 determines the sampled parameter data does exceed the retrieved predetermined parameter data threshold, the controller 405 retrieves, at 550, a second predetermined output pattern corresponding to the predetermined data threshold. The controller 405 may retrieve the second predetermined output pattern from the NVM 415. At 530, the controller 405 transmits an actuate command to an output indicator in accordance with the retrieved second predetermined output pattern.

In various embodiments, the controller may receive, at 525, 550, the first and second predetermined output patterns, respectively, from a portable electronic device. A user may dynamically transmit the predetermined status data threshold such that the controller 405 receives, at 510, the transmitted predetermined status data threshold. A user may dynamically transmit the predetermined parameter data threshold such that the controller 405 receives, at 535, the transmitted predetermined status data threshold.

In an illustrative embodiment, a sensor data store may be operably coupled to the sensor controller. The sensor data store may include a program of instructions that, when executed by the sensor controller, cause the sensor controller to perform operations to communicate sensor data to the tower light controller. The instructions executed by the sensor controller may operate, for example, to allow the sensor to receive parameter data from at least one sensor in the tower light assembly. Further instructions may operate, for example, to cause the sensor controller to transmit the received parameter data. In some embodiments, the sensor controller may transmit in response to a request from the tower light controller. Some implementations may include instructions to interrupt the tower light controller, for example, when the received parameter data exceeds some threshold conditions. The transmitted message may be from the sensor controller, for example, to a destination node on a local area network, or to the tower light controller itself.

The tower light may further include a tower light data store operably coupled to the tower light controller. The tower light data store may include a program of instructions that, when executed by the tower light controller, cause the tower light controller to perform operations to control the tower light. The instructions executed by the tower light controller may operate, for example, to generate a request message to transmit sensor data. Further instructions may operate, for example, to cause the tower light controller to transmit the generated request message to the sensor controller.

Figure 6:
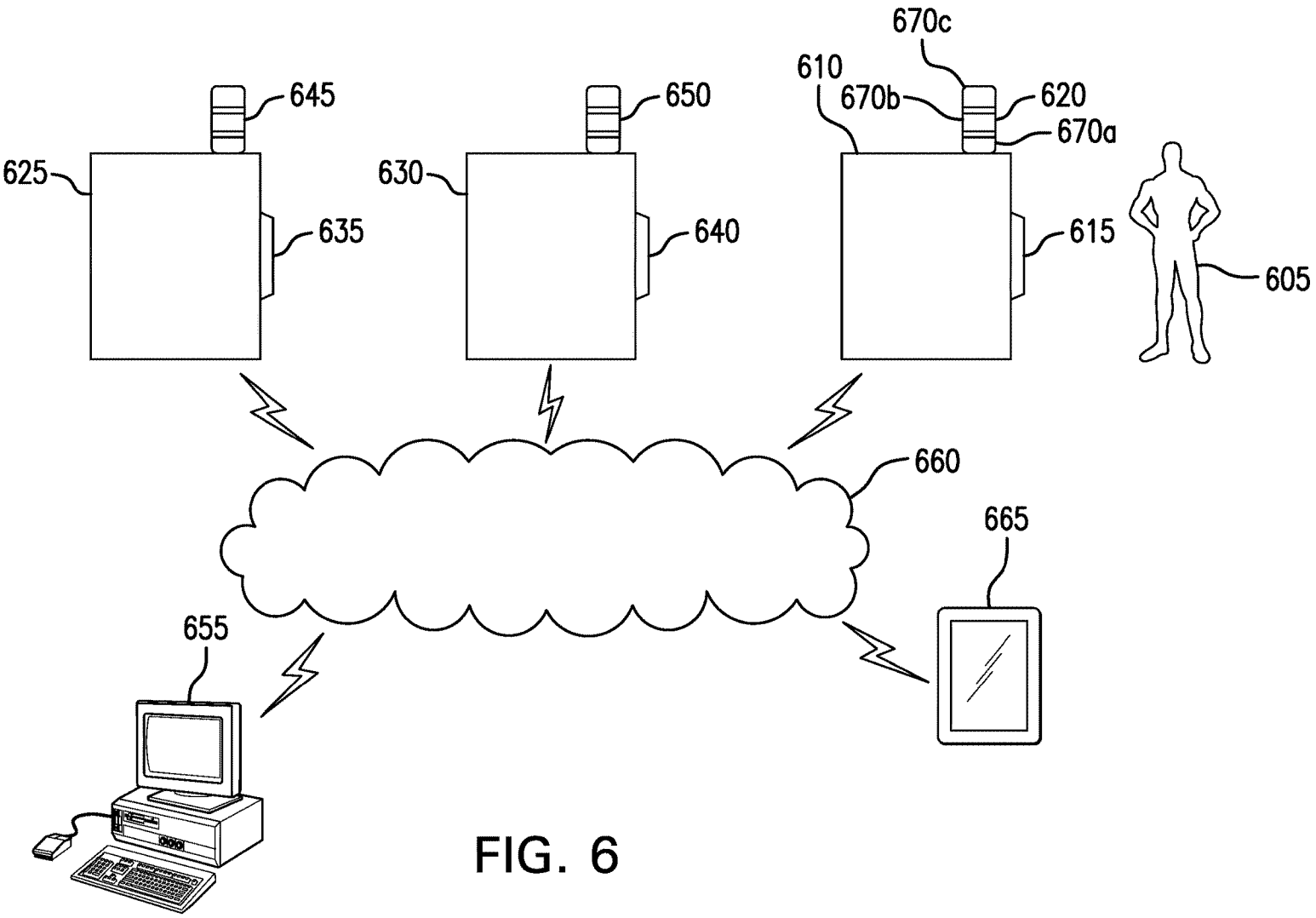
FIG. 6 depicts a perspective view of a network system having multiple ASTLAs.

FIG. 6 depicts a perspective view of a network system having multiple ASTLAs. A user 605 stands at a control station 610. The control station 610 includes a control panel 615. A ASTLA 620 operably mounts on the control station 610. As depicted, a pair of control stations 625, 630 each include a control panel 635, 640, respectively. An ASTLA 645, 650 operably mounts on the control station 625,630, respectively. Each ASTLA 620, 645, 650 includes wireless communication capabilities (e.g., wireless component 460). A processing station 655 may receive information from any of the ASTLAs 620, 645, 650, via a network 660. A portable electronic device 665 may receive information from any of the ASTLAs 620, 645, 650, via the network 660.

As depicted, the ASTLA 620 may not be within the line of sight of the user 605. In various embodiments, the user 605 may receive an alert from the ASTLA 645 on the control panel 615. For example, in the event the ASTLA 645 detects an environmental parameter that exceeds a predetermined parameter data threshold, the ASTLA 645 may generate an alert signal to transmit to the control station 625. The control station 625 may transmit the alert signal to the control station 610 via the network 660. The control station 610 may transmit the alert signal to the ASTLA 620. The ASTLA 620 includes light indicators 670*a*-670*c*. In response to the received alert message, the ASTLA 620 may illuminate the light indicators 670*a*-670*c* to alert the user 605 of a possible malfunction detected by the ASTLA 620.

Figure 7:
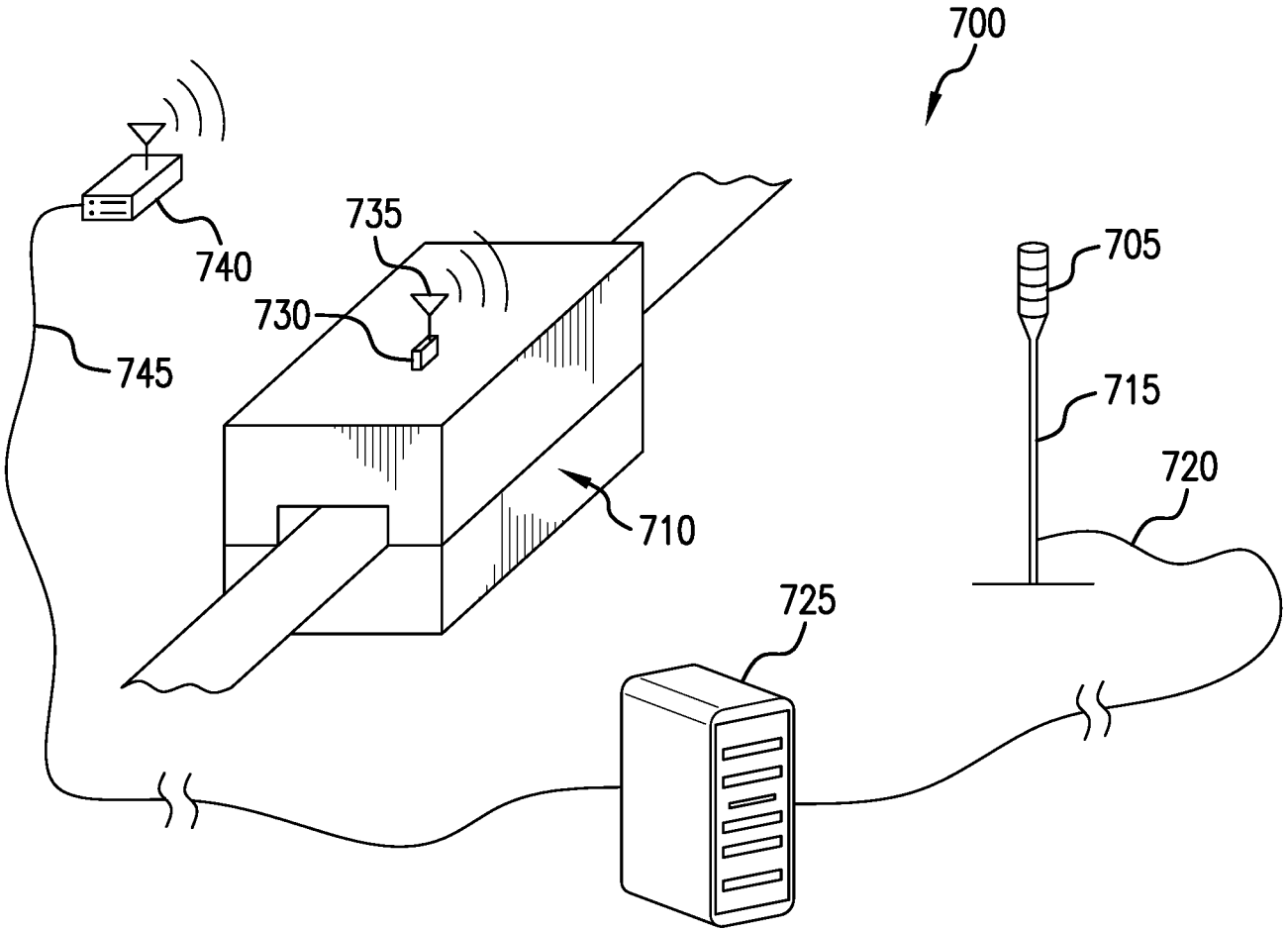
FIG. 7 depicts a perspective view of a manufacturing facility having an exemplary augmented sensing tower light assembly (ASTLA) located near yet separate from monitored equipment.

FIG. 7 depicts a perspective view of a manufacturing facility having an exemplary augmented sensing tower light assembly (ASTLA) located near yet separate from monitored equipment. A manufacturing facility 700 includes a ASTLA 705. The ASTLA 705 is located in an area near monitored equipment 710, without being attached or directly coupled to the monitored equipment 710. The ASTLA 705 is supported by a pole 715. A first electrical connection 720 is operably coupled to the ASTLA 705. For example, the ASTLA 705 may include an Ethernet interface that may connect to an Ethernet cable, which may be the first electrical connection 720. The first electrical connection 720 is communicatively coupled to a remote server 725.

Included with the monitored equipment 710 is a module 730 that collects status data associated with the monitored equipment 710. In this illustrative embodiment, the module 730 includes a wireless transmitter configured to communicate wireless data signals to a network device 740. The network device 740 is operably coupled to a second electrical connection 745. The second electrical connection 745 is communicatively coupled to the remote server 725.

In some examples, the module 730 may send status data associated with the monitored equipment to the remote server 725 via the network device 740 and second electrical connection 745. The status data may be then be processed at the remote server 725. In response to processing the status data, the remote server 725 may send data signals to the ASTLA 705 via the first electrical connection 720. For example, status data may indicate that a machine failure has occurred (e.g., a failed bearing) at the monitored equipment 710. The remote server 725 may receive this status data indicative of a machine failure, and in response, may send an alert signal to the ASTLA 705 commanding the ASTLA to flash alert indicator lights to advantageously apprise persons around the ASTLA 705 that a machine failure at the monitored equipment has occurred.

In various embodiments, the monitored equipment 710 and the ASTLA 705 may be co-located or disposed adjacent to one another. Co-located devices may advantageously allow for the ASTLA 705 to directly monitor various parameters (e.g., sound, temperature, vibrations) in the vicinity of the monitored equipment 710. For example, an ASTLA 705 located on top of the monitored equipment may reduce the amount of floor space taken up by various devices. In some examples, the monitored equipment 710 and the ASTLA 705 may not be co-located. Non-co-located devices may advantageously allow for the ASTLA 705 to remotely monitor variables that may nevertheless have an impact on the monitored equipment 710.

Figure 8:
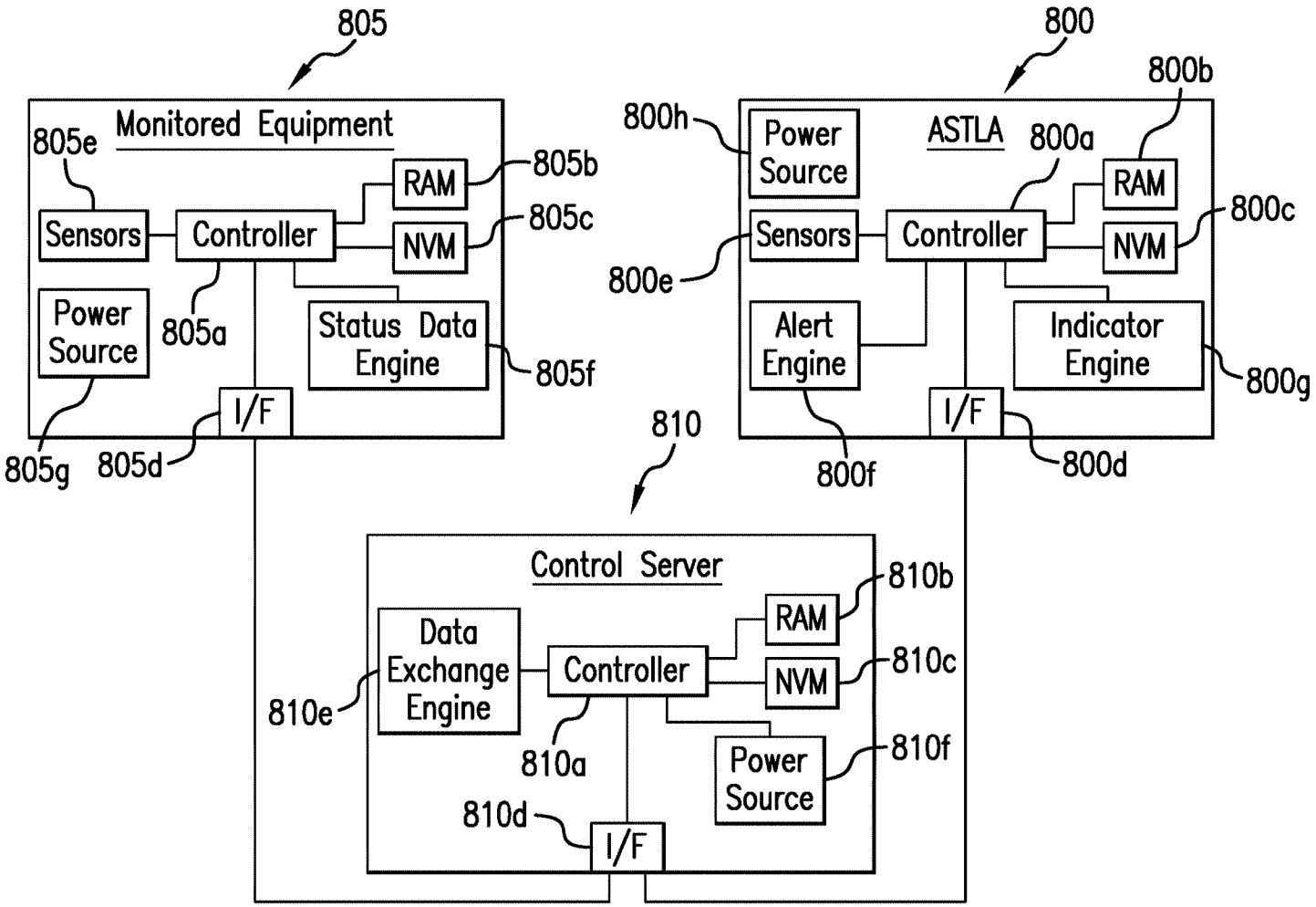
FIG. 8 depicts a block diagram view of an exemplary ASTLA control unit, monitored equipment, and control sever.

FIG. 8 depicts a block diagram view of an exemplary ASTLA control unit, monitored equipment, and control sever. Shown in FIG. 8 are an ASTLA control unit 800*a*, monitored equipment 805, and a control server 810. An ASTLA control unit 800 includes an ASTLA controller 800*a*. The ASTLA controller 800*a* is operably coupled to RAM 800*b* and NVM 800*c*. The ASTLA controller 800*a* is also coupled to at least one sensor 800*e* that may detect various status parameters around monitored equipment 805. For example, the at least one sensor 800*e* may be a gas detection sensor that may output an electrical signal indicative of dangerous gasses (e.g., CO, $H_2S$) being present in the area around the monitored equipment 805.

An alert engine 800*f* operably connected to the ASTLA controller 800*a* may generate an alert message in response to an alert signal sent from the ASTLA controller 800*a*. An indicator engine 800*g* operably connected to the ASTLA controller 800*a* may transmit an actuate command to an output indicator, such as a light indicator, for example. Also operably coupled to the ASTLA controller 800*a* is an interface 800*d* configured to send and/or receive data signals to/from the control server 810. The ASTLA control unit 800 also includes a power source 800*h* that powers the various components of the ASTLA control unit 800.

The monitored equipment 805 includes a monitored equipment controller 805*a*. The monitored equipment controller 805*a* is operably coupled to RAM 805*b* and NVM 805*c*. The monitored equipment controller 805*a* is also coupled to at least one monitored equipment sensor 805*e* that may collect status data pertaining to the monitored equipment 805. For example, the at least one monitored equipment sensor 805*e* may be a conveyor speed sensor that may detect the speed of the conveyor belt 130.

The monitored equipment 805 also includes a status data engine 805*f* that may perform various handling and/or processing functions to the status data relating to the monitored equipment 805. Also operably coupled to the controller 805*a* is an interface 805*d*. The interface 805*d* is communicatively coupled to the control server 810. In an illustrative example, if the monitored equipment sensor 805*e* (e.g., conveyor speed sensor) detects that the speed of the conveyor belt 130 is too slow or too fast, the status data engine 805*f* may instruct the monitored equipment controller 805*a* to send a corresponding alert signal to the interface 805*d*. The interface 805*d* may then forward this alert signal on to the controller server 810. The monitored equipment 805 also includes a power source 805*g* that powers the various components of the monitored equipment 805.

The control server 810 includes a processor 810*a*. Operatively coupled to the processor 810*a* is RAM 810*b* and NVM 810*c*. The processor 810*a* is also operatively coupled to an interface 810*d* and a data exchange engine 810*e*. The control server 810 is communicatively coupled (via interface 810*d*) to both the ASTLA control unit 800 (via interface 800*d*) and the monitored equipment 805 (via interface 805*d*). The data exchange engine 810*e* determines what data is sent to the ASTLA control unit 800 and the monitored equipment 805. For example, an alert signal sent from the monitored equipment 800 may be sent to the control server 810. In response, the data exchange engine 810*e* may then send another alert signal to the ASTLA control unit 800 commanding the indicator engine 800*g* to sound an alarm. In this sense, the data collected at the ASTLA control unit 800 or the monitored equipment 805 may be processed non-locally (e.g., at the control server 810). For example, there may be indirect communication between the ASTLA control unit 800 and the monitored equipment 805 via the control server 810.

In some embodiments, various components of an ASTLA system may perform polling operations. For example, the control server 810 may poll (e.g., actively sample the status of) the ASTLA control unit 800 or the monitored equipment 805. The polling may be periodic, which may advantageously provide regular updates of the status of other devices. In some examples, the data communication may be performed asynchronously, which may allow for more flexibility in transmitting data between devices in response to determined events. In various examples, the data communication may be performed as a specific rate, which may provide predictability for status monitoring.

In some examples, the ASTLA control unit 800 and the monitored equipment 805 may share a common power source. For example, a power supply may provide electrical power to both the ASTLA control unit 800 and the monitored equipment 805. In various embodiments, the ASTLA control unit 800, the monitored equipment 805, and/or the control server 810 may be Internet of Things (IoT) devices.

Although various embodiments have been described with reference to the Figures, other embodiments are possible. For example, an ASTLA may detect environmental parameters (e.g., proximity, humidity, sound, vibration, smoke, air pressure, motion) external to the monitored equipment or the ASTLA. The ASTLA (e.g., the ASTLA 300) may be arranged to detect multiple environmental parameters specific to a desired application. As such, a user may dynamically arrange the ASTLA for a specific application by interchanging sensor modules, for example. The ASTLA may provide an earlier indication of a potentially detrimental environmental parameter by detecting the parameter within a monitoring space. In the event of a sensor failure, a user may simply replace the ASTLA without interruption to the monitored equipment. In an illustrative example, with reference to FIG. 3, a user may simply replace the sensor module 320 in the event the onboard sensor 330 fails.

The ASTLA 300 may create an augmented monitoring space external to the monitored equipment. In an illustrative example, in a wave soldering application, the augmented ASTLA 300 may detect a potentially detrimental environmental parameter. For example, the ASTLA 300 may detect water (e.g., malfunctioning sprinkler head) in the augmented monitoring space that may prevent wet circuit boards from being processed into scrap (e.g., waste) by the monitored equipment.

In an illustrative example, the augmented monitoring space may be directed towards the monitored equipment. For example, a user may choose to monitor an additional parameter of the monitored equipment, such as, for example, temperature. The augmented monitoring space may be directed towards the monitored equipment while also monitoring the space around the monitored equipment. In another illustrated embodiment, the processing station 655 or portable electronic device 665 may request information from multiple ASTLAs and compare results to a predetermined set of criteria as to overall performance of the network 660 as a whole.

With reference to FIG. 1, an ASTLA may be programmed to alert a user in the event of a detected environmental parameter in addition to a triggering event from the monitored equipment 110. The light indicator modules 310*a*, 310*b* may be programmed to illuminate in different patterns based on a triggering event or a detected environmental parameter. As such, a user may quickly recognize whether the monitored equipment status or the detected environmental parameter caused the illumination of the indicator lights and respond promptly to the alert.

The ASTLA may be unitary (e.g., ASTLA 200) or modularly (e.g., 300) formed. The output indicators may include visual and audio indicators. With reference to FIGS. 3 and 4, the programmable controller, such as the ASTLA control unit 400 and sensor module 320, may be a modular component that may be retrofitted to conventional tower light assemblies. Different sensors may be used for different applications. For example, a sensor may include a microphone to detect sounds within a predetermined frequency.

The ASTLA control unit 400 may include communication capabilities to transmit and receive sensor data to a remote control station, such as the portable electronic device 455, for example. As such the controller 405 may transmit sensor information to a remote processing station. Advantageously, a more cost efficient controller may be used because the remote processing station may execute the information processing. The portable electronic device (e.g., portable electronic device 665) may receive sensor information or alerts from the controller 405. Further, a user may program the controller 405 via the portable electronic device. A user may program the ASTLA control unit 400 with predetermined audio patterns (e.g., sound files), for example, via the portable electronic device. As such, the ASTLA 300, for example, may emit predetermined audio patterns such that a user may recognize the source of the alert without needing to consult a control panel (e.g., control panel 610).

In some examples, there may not be a direct wired connection between the ASTLA 100 and the monitored equipment 110. For example, there may be a remote control system that may receive information pertaining to the state of the monitored equipment 110 (e.g., whether the conveyor 130 is blocked). The remote control system may be communicatively coupled (e.g., electrically, wirelessly) to the ASTLA 100 such that the remote control system may control various functions of the ASTLA 100 (e.g., the illumination of the indicator lights 120*a*-120*c*; sounds emitted from the audio indicator 240). In this sense, there may be indirect communication between a parametric monitoring module on the monitored equipment 110 and the ASTLA 100 via a central network. In some examples, the indirect communication between the ASTLA 100 and the monitored equipment 110 may be accomplished wirelessly.

The ASTLA 100 may include a data interface configured to receive a data signal indicative of a parameter being monitored at the monitored equipment 110. In such a situation, the ASTLA 100 may not directly communicate with the monitored equipment 110. Furthermore, the ASTLA 100 may be located in the vicinity of the monitored equipment 110, but not attached to or coupled on the monitored equipment 110. For example, the ASTLA 100 may be disposed on a pole that is near or around the monitored equipment 110, but may not be in direct physical contract with the equipment 110.

In various embodiments, the ASTLA 100 may be configured to detect various parameters in the area around the monitored equipment 110. In this context, the word "around" may refer to an area within a distance of about 1 cm, 10 cm, 1 m, 2 m, 5 m, 10 m, 20 m, 50 m, or at least about 100 m or more of the monitored equipment 110. The word "around" may be dependent on the type of onboard sensor 230 included with the ASTLA 200. For example, an acoustic sensor may be able to detect sounds that may originate from 100 m or more away from the ASTLA 110. In another example, a humidity sensor may be able to detect local humidity in an area less than 1 m away from the ASTLA 100. In yet another example, a gas detection sensor may be able to detect ambient gases in an area less than 10 cm away from the ASTLA 100.

Use of acoustic sensors in the ASTLA 100 may advantageously allow for detection of a machine failure. For example, a bearing that fails on the monitored equipment 110 may result in a high frequency acoustic signal that may be detected by the acoustic sensor in the ASTLA 100. This may be advantageously allow for determination of machine failure by identifying specific acoustic signatures indicative of machine failure (e.g., 32-36 kHz frequency sound signals).

In various examples, a module included with the ASTLA 100 (e.g., audio indicator 240, audio indicator module 340, light indicator modules 310*a*, 310*b*) may not have its own controller. In such examples, the module may only have at least one sensor or at least one output element that may interface with other electronics included with the ASTLA 100. For example, the audio indicator module 340 may have an audio output that may respond to input from a controller included with the ASTLA, where the controller is separate from the audio indicator module 340. In such situations, the controller of the ASTLA may only require a software upgrade to interface with a sensor or output element in the module.

In some examples, a sensor may be integrated with an ASTLA produced by an original equipment manufacturer (OEM). For example, a sensor may be included with the light indicator module 310*a*, 310*b*, such that the sensor is not an addon to the ASTLA but is rather integrated with the ASTLA.

In various examples, the ASTLA may hang down from a structure located at a specific height. For example, the ASTLA may hang from a rod that is fixedly coupled to a ceiling. The rod may include cables that provide power and electrical connections (e.g., data paths) to the ASTLA.

Some aspects of embodiments may be implemented as a computer system. For example, various implementations may include digital and/or analog circuitry, computer hardware, firmware, software, or combinations thereof. Apparatus elements can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Some embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example and not limitation, both general and special purpose microprocessors, which may include a single processor or one of multiple processors of any kind of computer. Generally, a processor will receive instructions and data from a read-only memory or a random access memory or both. The essential elements of a computer are a processor for executing instructions and one or more memories for storing instructions and data. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits). In some embodiments, the processor and the member can be supplemented by, or incorporated in hardware programmable devices, such as FPGAs, for example.

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. An exemplary embodiment may be implemented in a computer system that includes a graphical user interface and/or an Internet browser. To provide for interaction with a user, some implementations may be implemented on a computer having a display device, such as an LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the first receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, and the computers and networks forming the Internet. Other implementations may transport messages by broadcasting to all or substantially all devices that are coupled together by a communication network, for example, by using Omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Fire wire, ATA/IDE, RS-232, RS-422, RS-485, 802.11a/b/g, Wi-Fi, WiFi-Direct, Li-Fi, BlueTooth, Ethernet, IrDA, FDDI (fiber distributed data interface), token-ring networks, or multiplexing techniques based on frequency, time, or code division. Some implementations may optionally incorporate features such as error checking and correction (ECC) for data integrity, or security measures, such as encryption (e.g., WEP) and password protection.

In various embodiments, the computer system may include Internet of Things (IoT) devices. IoT devices may include objects embedded with electronics, software, sensors, actuators, and network connectivity which enable these objects to collect and exchange data. IoT devices may be in-use with wired or wireless devices by sending data through an interface to another device. IoT devices may collect useful data and then autonomously flow the data between other devices.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. An augmented light tower monitoring system, the augmented light tower monitoring system comprising:

a tower light assembly comprising:

at least one indicator light;

a tower light base module having a data interface adapted to receive status data pertaining to one or more devices that make up a unit of monitored equipment;

a tower light controller operably connected to the data interface and to the at least one indicator light;

a sensor adapted to detect a first parameter data within a predetermined monitoring space around the tower light assembly;

a sensor controller operably connected to the sensor and in operable communication with the tower light controller;

a sensor data store operably coupled to the sensor controller, wherein the sensor data store comprises a program of instructions that, when executed by the sensor controller, cause the sensor controller to perform sensor operations to communicate sensor data to the tower light controller, the sensor operations comprising:

receive the first parameter data from the sensor; and, transmit the received first parameter data in response to a request from the tower light controller; and, a tower light data store operably coupled to the tower light controller, wherein the tower light data store comprises a program of instructions that, when executed by the tower light controller, cause the tower light controller to perform tower light control operations, the tower light control operations comprising:

generate a request message to transmit sensor data; and, transmit the generated request message to the sensor controller.

2. The augmented light monitoring system of claim 1, wherein the tower light control operations further comprise:

retrieve from the tower light data store a predetermined status threshold, wherein the predetermined status data threshold comprises a range of one or more status data criteria for operation of the unit of monitored equipment;

sample the status data received from the unit of monitored equipment; and, in response to the sampled status data exceeding the predetermined status data threshold, actuate the at least one indicator light.

3. The augmented light monitoring system of claim 1, wherein the tower light controller comprises the sensor controller.

4. The augmented light monitoring system of claim 1, wherein the sensor operations further comprise:

in response to the first parameter data exceeding the predetermined parameter data threshold, the sensor controller transmits an alert to a remote station.

5. The augmented light monitoring system of claim 1, further comprising an audio indicator operably connected to the tower light controller wherein the audio indicator operably stacks with the at least one indicator light.

6. The augmented light monitoring system of claim 5, wherein the tower light control operations further comprise:

in response to the sampled status data exceeding the predetermined status threshold, the tower light controller actuates the audio indicator according to a first predetermined audio output pattern.

7. The augmented light monitoring system of claim 6, wherein the sensor operations further comprise:

in response to the first parameter data exceeding the predetermined parameter data threshold, the sensor controller sends a signal to the tower light controller to actuate the audio indicator according to a second predetermined audio output pattern.

8. The augmented light monitoring system of claim 7, wherein the first predetermined audio output pattern equals the second predetermined audio output pattern.

9. The augmented light monitoring system of claim 1, wherein the sensor comprises an audio sensor.

10. The augmented light monitoring system of claim of 1, further comprising a first cylindrical-shaped housing for supporting the sensor, the sensor controller, and the sensor data store, wherein the sensor controller electrically communicates with the tower light controller when the first cylindrical-shaped housing is releasably stacked with a second cylindrical-shaped housing comprising the tower light controller and the tower light data store.

11. An augmented light tower monitoring system, the augmented light tower monitoring system comprising:

a tower light assembly comprising:

at least one indicator light;

a tower light base module having a data interface adapted to receive status data from one or more devices that make up a unit of monitored equipment;

a tower light controller operably connected to the data interface, the tower light controller operably connected to the at least one indicator light;

means for sensing a first parameter data within a predetermined monitoring space around the tower light assembly;

a sensor controller operably connected to the sensing means and in operable communication with the tower light controller;

a sensor data store operably coupled to the sensor controller, wherein the sensor data store comprises a program of instructions that, when executed by the sensor controller, cause the sensor controller to perform sensor operations to communicate sensor data to the tower light controller, the sensor operations comprising:

receive the first parameter data from the sensor; and, transmit the received first parameter data in response to a request from the tower light controller.

12. The augmented light monitoring system of claim 11, further comprising an audio indicator operably connected to the tower light controller.

13. The augmented light monitoring system of claim 12, further comprising a first cylindrical-shaped housing for supporting the sensing means, the sensor controller, and the sensor data store, wherein the sensor controller electrically communicates with the tower light controller when the first cylindrical-shaped housing is releasably stacked with a second cylindrical-shaped housing comprising the tower light controller and the tower light data store.

* * * * *